US007559724B1

(12) United States Patent
Olen

(10) Patent No.: US 7,559,724 B1
(45) Date of Patent: Jul. 14, 2009

(54) ADJUSTABLE AND PORTABLE TRENCH SUPPORT

(76) Inventor: Jeffrey D. Olen, 134 Oberlin Dr., Butler, PA (US) 16001

( * ) Notice: Subject to any disclaimer, the term of this patent is extended or adjusted under 35 U.S.C. 154(b) by 0 days.

(21) Appl. No.: 12/077,035

(22) Filed: Mar. 17, 2008

(51) Int. Cl.
*E02D 17/08* (2006.01)

(52) U.S. Cl. ..... 405/282; 405/272

(58) Field of Classification Search ..... 405/282, 405/283, 272
See application file for complete search history.

(56) References Cited

U.S. PATENT DOCUMENTS

| | | | | |
|---|---|---|---|---|
| 841,773 | A * | 1/1907 | Fitzgerald | 405/282 |
| 3,621,660 | A * | 11/1971 | Krings | 405/282 |
| 4,056,940 | A | 11/1977 | Fisher | |
| 4,090,365 | A | 5/1978 | Nieber | |
| D252,950 | S | 9/1979 | Birchfield | |
| 4,199,278 | A * | 4/1980 | Koehl | 405/282 |
| 4,259,028 | A | 3/1981 | Cook | |
| 4,752,157 | A | 6/1988 | Ischebeck et al. | |
| 4,993,880 | A | 2/1991 | Collins | |
| 5,096,334 | A * | 3/1992 | Plank | 405/282 |
| 5,310,290 | A | 5/1994 | Spencer | |
| 5,344,258 | A * | 9/1994 | Papadopoulos | 405/282 |
| 5,931,608 | A | 8/1999 | Wilkinson | |
| 7,027,471 | B2 | 5/2006 | Kadiu | |
| 7,056,067 | B2 | 6/2006 | Kadiu | |
| 2004/0170478 | A1 | 9/2004 | Kadiu | |

FOREIGN PATENT DOCUMENTS

JP 57029732 A * 2/1982

* cited by examiner

*Primary Examiner*—Frederick L Lagman

(57) ABSTRACT

A portable and adjustable trench support for placement within a trench for shoring up and maintaining the integrity of the trench walls so that workers can work safely within the trench includes a pair of support plates disposed within the trench and against the opposed trench walls, and the support plates including on their interior sides a pair of support arm guides with each support arm guide having a vertical channel and a number of offsets so that support arms can be slid within the channels and vertically positioned in the desired offsets wherein the pair of support arms mounted to the support arm guides of one support plate have larger diameters than the support arms mounted to the opposite support arm guides thereby allowing for the telescopic slidable insertion of the smaller diameter support arms into the larger diameter support arms, and then connected thereto so that the spacing of the support plates can accommodate trenches of various widths.

15 Claims, 4 Drawing Sheets

ADJUSTABLE AND PORTABLE TRENCH SUPPORT

FIELD OF THE INVENTION

The present invention pertains to shoring devices and protective structures, and more particularly pertains to a portable trench support that is adjustable to accommodate varying trench widths and dimensions.

BACKGROUND OF THE INVENTION

Trenches are dug in the ground for many purposes. Some of the purposes include laying utility and fiber optic lines, repairing such lines, and moving such lines if roadways and bridges need constructed. Also, many rural residences still use on-lot and septic systems, and problems can be encountered with such lines (cracks and blockages) that require some portion or the entire line to be dug up so that the lines can be repaired. One primary danger is that the trench walls of the trench that has been dug could collapse on the workers standing in the trench. With the acute concern for liability and consequent need to protect anyone standing for any period of time within the trench, some type of apparatus is needed to support the trench walls for enhancing the safety and security of anyone standing and working within the trench.

A typical trench support consists of two pieces of steel plate interconnected by support rods that have been welded to the interior sides of the steel plates. Such makeshift support is heavy, difficult to maneuver in the trench for moving and repositioning as the workers move along the length of the trench, and awkward to transport and store as it cannot be broken down for easy and compact storage and transport.

The prior art discloses a variety of shoring, excavation, and support structures for trenches and excavations.

For example, the Fisher patent (U.S. Pat. No. 4,056,940) discloses a trench box height adaptor that includes spaced walls from which tubular collar project and into which spreader pipes are inserted for spacing and interconnecting the spaced walls.

The Nieber patent (U.S. Pat. No. 4,090,365) discloses a portal frame for a trench box stack that includes an adjustable trench box structure whose depth is adjustable to allow for the clearance of conduit and pipe.

The Birchfield patent (U.S. des. Pat. 252,950) discloses a design for a lightweight trench box that includes spacing pipes mounted to interiorly projecting collars.

The Cook patent (U.S. Pat. No. 4,259,028) discloses a water and debris impermeable trench box panel wherein each panel includes a lightweight foamed filler.

The Ischebeck et al. patent (U.S. Pat. No. 4,752,157) discloses a trench shoring box unit that includes partition walls spaced from each other and supported by adjustable length braces.

The Collins patent (U.S. Pat. No. 4,993,880) discloses a trench-box panel that includes a pair of opposed arrays of elongated horizontal members with the horizontal members of each array having their ends staggered to accommodate angle members and flat members that support struts that space the arrays from each other in the trench.

The Spencer patent (U.S. Pat. No. 5,310,290) discloses a protective structure for excavations that includes a pair of protective panels constructed of corrugated aluminum sheet and which is retained in their spaced-apart relations by a plurality of spreader beams.

The Wilkinson patent (U.S. Pat. No. 5,931,608) discloses a trench shoring transport device that includes a frame assembly movable on wheels and from which depend one or more trench boxes that can be lowered into place by hydraulic vertical members.

The Kadiu patents (U.S. patents/application publication no.s 2004/01700478 A1, 7,048,471 B2, and 7,056,067 B2) discloses shoring devices for trenches and rectangular and polygonal pits and which includes a pair of shoring panels with each panel having vertical struts mounted to their opposed ends and at least one strutting assembly mounted to the opposed vertical struts of the panels for spacing the panels from each other and maintaining the panels in their spaced relation.

Nonetheless, despite the ingenuity of the above devices, there remains a need for a lightweight trench support having support plates whose spacing from each other is adjustably accomplished by extendible and retractable slidably adjustable support arms.

SUMMARY OF THE INVENTION

The present invention comprehends a portable and adjustable trench support for shoring up and stabilizing the walls of trenches, furrows, excavation pits, etc., in order to maintain the integrity of the trenches, furrows, excavation pits, etc., and to protect anyone standing and working therein. Working in trenches is dangerous environment, and with the concern that all entities—small businesses, large businesses, sole proprietors, corporations, and governmental agencies—have for liability and litigation, anything that can make such work safer is highly desirable.

Thus, the adjustable and portable trench support of the present invention includes a pair of generally rectangular-shaped support plates with each support plated disposed against the respective walls of the trench for supporting the walls and safeguarding the worker. Each support plate includes an upper end and a lower end, and mounted to the upper end are a pair of spaced-apart loops on which the hook of a cable or chain can be placed for lifting, moving, and positioning the support plate. Each support plate includes an interior side, and mounted to the respective interior sides are a pair of spaced-apart support arm guides. The support arm guides are upwardly opening and each defines a longitudinal channel commensurate in length with the respective support arm guide. In addition, each support arm guide includes at least four l-shaped offsets spaced along the vertical length of that respective support arm guide with each offset having an offset slot that registers with the respective longitudinal channel.

A plurality of tubular-shaped support arms or rods is used to maintain the support plates in their opposed and vertically upright disposition against the opposed walls of the trench. More specifically, the support arms or rods include four pairs of support arms with each pair comprising a large diameter support arm and a corresponding small diameter support arm. The small diameter support arms are telescopically receivable and slidably adjustable within the large diameter support arms. Moreover, both the small and large diameter support arms include flared insertion ends and the flared insertion ends of both the small and large diameter support arms have the same diameter. The small and large diameter support arms include pairs of aligned apertures spaced along the top and bottom of the support arms.

The trench support is assembled beside and in general alignment with the trench so that the proper spacing of the support plates can be achieved by simply "eyeballing" the width of the trench. The flared insertion ends of the large diameter support arms are slid down into the channels of the support arm guides of one support plate, and then the support arms are further slid into the desired offset. The flared insertion ends of the small diameter support arms are slid down into the longitudinal channels of the support arm guides of the other support plate, and then they are further slid down into the offsets that correspond to, and are aligned with, the offsets into which the large diameter support arms are seated. The support plates are then moved toward each other so that the small diameter support arms can be inserted into the bores of the large diameter support arms. After the back and forth adjustments of the small diameter support arms within the large diameter support arms are made to obtain the proper width and spacing of the support plates, the appropriate apertures for the pairs of small and large diameter support arms are aligned for the insertion therethrough of locking bolts thereby fixing the pairs of small and large diameter support arms together. The trench support can then be lifted and set in position within the trench.

The present invention provides enhanced protection for anyone working in a trench and has the added advantages of including telescopically adjustable support arms for fitting the trench support into trenches of various widths, support arms that are removable to facilitate the breaking down, storage, and transport of the adjustable trench support, and support arms that can be positioned at various positions on the support plates thereby maximizing the space between the support plates for tools, equipment, etc.

It is an object of the present invention to provide an adjustable and portable trench support that is transversely adjustable relative to the longitudinal orientation of the trench so that components of the trench support can be placed directly against the walls of trench for shoring up the trench walls and protecting anyone working within the trench.

It is another object of the present invention to provide an adjustable and portable trench support that includes vertically adjustable support arms so that the support arms can be positioned at heights that do not interfere with work occurring in the trench.

It is still another object of the present invention to provide an adjustable and portable trench support that can be easily assembled and disassembled for set-up, use, and break down at various job sites.

These and other objects, features, and advantages will become apparent to those skilled in the art upon a perusal of the following detailed description read in conjunction with the accompanying drawing figures and appended claims.

DETAILED DESCRIPTION OF THE PREFERRED EMBODIMENT

Figure 1:
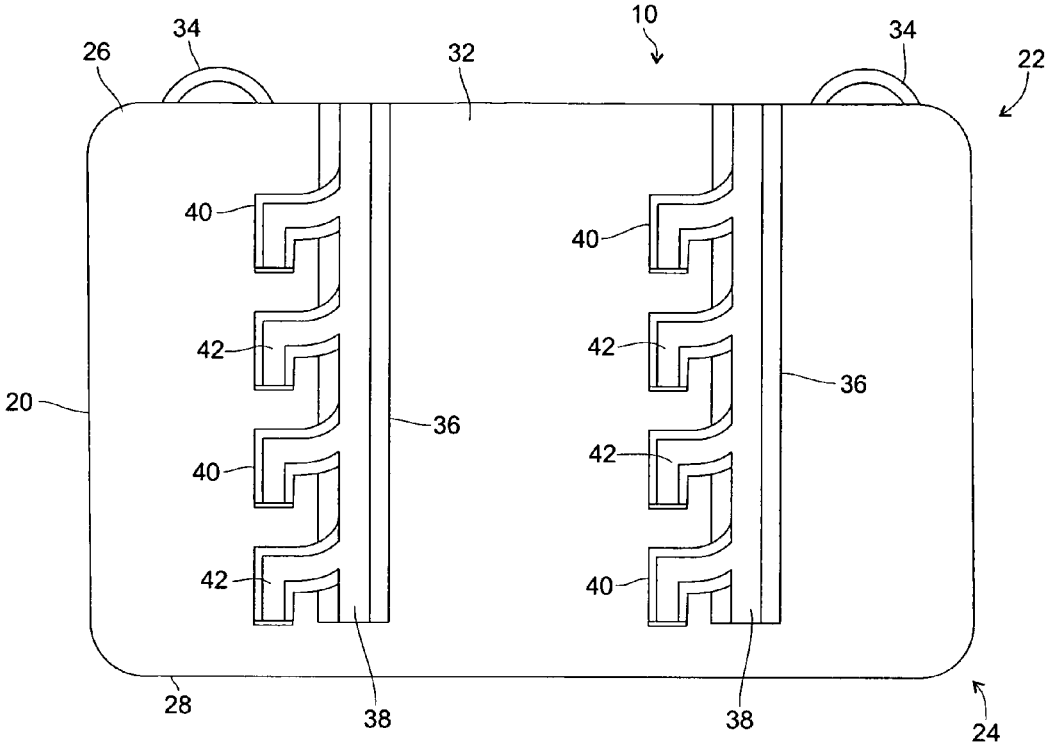
FIG. 1 is a side elevational view of the portable and adjustable trench support of the present invention illustrating the interior side of one support plate and structural components attached thereto.
Figure 2:
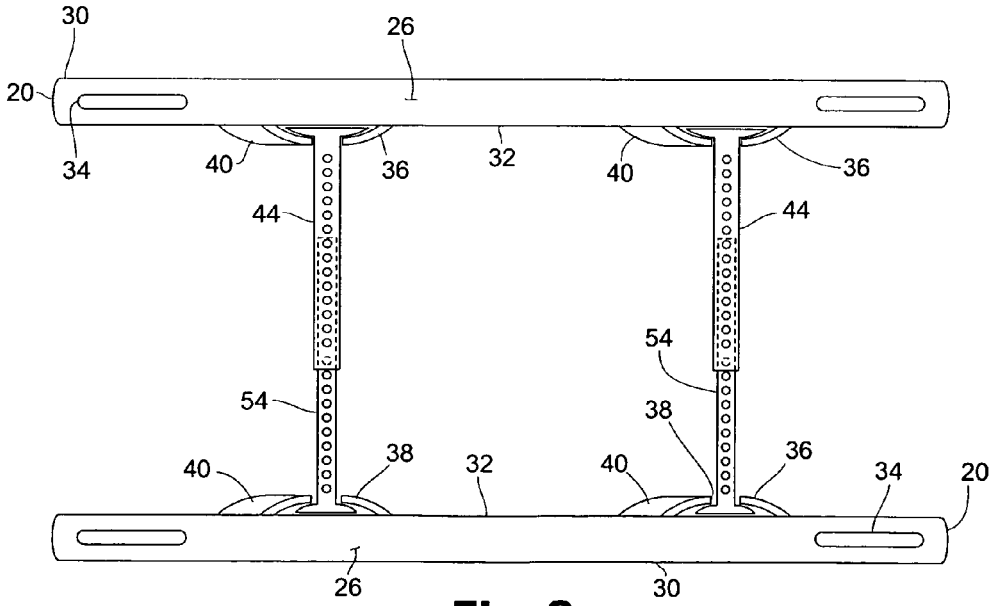
FIG. 2 is a top plan view of the portable and adjustable trench support of the present invention illustrating the spacing of the support plates from each other by first and second support arms.

Illustrated in FIGS. 1-10 is a portable and adjustable trench support 10 for disposition within a trench 16, excavation, furrow, pit, etc., for shoring up the trench 16 and protecting anyone working within the trench 16. The trench support 16 is assembled on the ground surface 12 beside the trench 16 and is then positioned adjacent and against the opposed trench walls 14 of the pre-dug trench 16. The trench support 10 provides enhanced safety and security for any workers standing and working within the trench 10 by maintaining the integrity of the trench walls 14 and preventing their collapse that could easily injure or kill any workers working within the trench 16. The trench support 10 of the present invention can be easily assembled and disassembled for use and movement along one trench or for use at various work sites.

Thus, as shown in FIGS. 1-10, the trench support 10 includes a pair of generally rectangular-shaped trench wall support plates 20. Each support plate 20 includes an upper end 22, an opposite lower end 24, an upper flat surface 26, and an opposed lower flat surface 28 that contacts the bottom floor 18 of trench 16. Each support plate 20 also includes a trench wall side 30 that faces and is adjacent—and most often placed contiguous to—the respective trench wall 14, and an opposite interior side 32. Mounted to the upper flat surfaces 26 of each support plate 20 is pair of eyes or loops 34 that are spaced from each other and extend upwardly from upper flat surfaces 26, so that hooks from construction and excavating equipment can be hooked thereon to position, move, place, remove and reposition the trench support 10 from the length of the trench 16, and, finally, to remove the trench support 10 from the trench 16 for break down and transport to another work site.

As shown in FIGS. 1-3, 9, and 10, mounted to each interior side 32 of each support plate 20 is a pair of spaced-apart support arm guides 36 that extend in a vertical orientation from the upper end 22 to the lower end 24 of each support plate 20. Each support arm guide 36 defines a longitudinal channel 38 commensurate in length with the respective support arm guide 36; and registering with each channel 38 are a plurality of l-shaped offsets 40. The longitudinal channels 38 are open at their upper ends and closed at their lower ends. The l-shaped offsets 40 are spaced from each other along the length of the support arm guides 36 and laterally extend from the respective support arm guides 36. Each l-shaped offset 40 includes an offset slot 42 coextensive with the configuration of the offset 40 and the offset slots 42 directly register with each channel 38.

Figure 3:
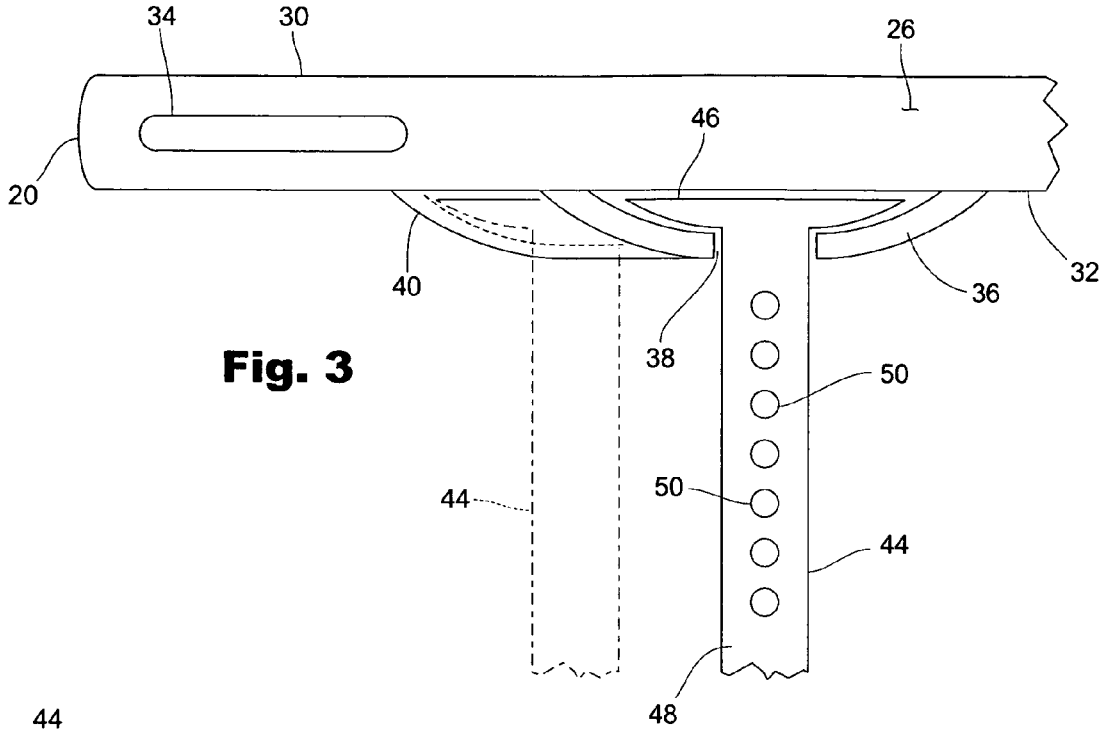
FIG. 3 is an enlarged sectional view of the portable and adjustable trench support of the present invention illustrating the placement of the flared end of the large diameter first support arm into the channel of the support arm guide.
Figure 4:
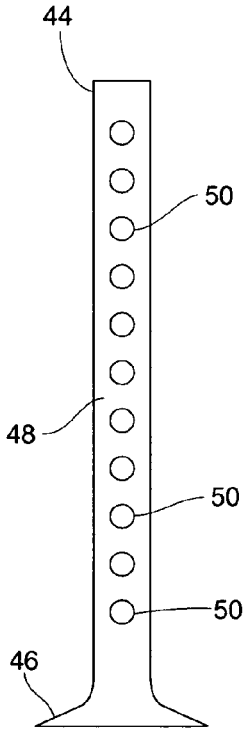
FIG. 4 is a front elevational view of the portable and adjustable trench support of the present invention illustrating one large diameter support arm.
Figure 5:
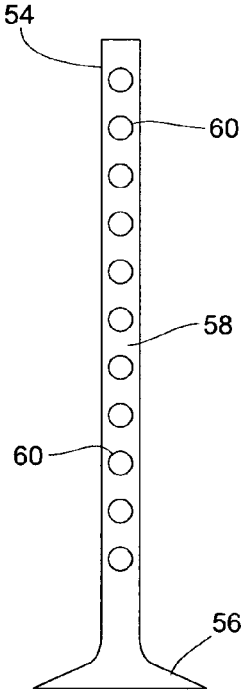
FIG. 5 is a front elevational view of the portable and adjustable trench support of the present invention illustrating one small diameter support arm.
Figure 6:
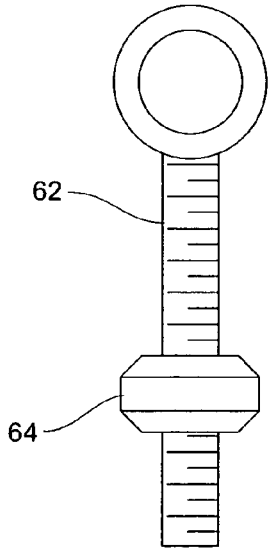
FIG. 6 is a front elevational view of the portable and adjustable trench support of the present invention illustrating one locking bolt and locking nut that is inserted through the aligned apertures of one pair of large and small support arms for securing the support arms to each other.
Figure 7:
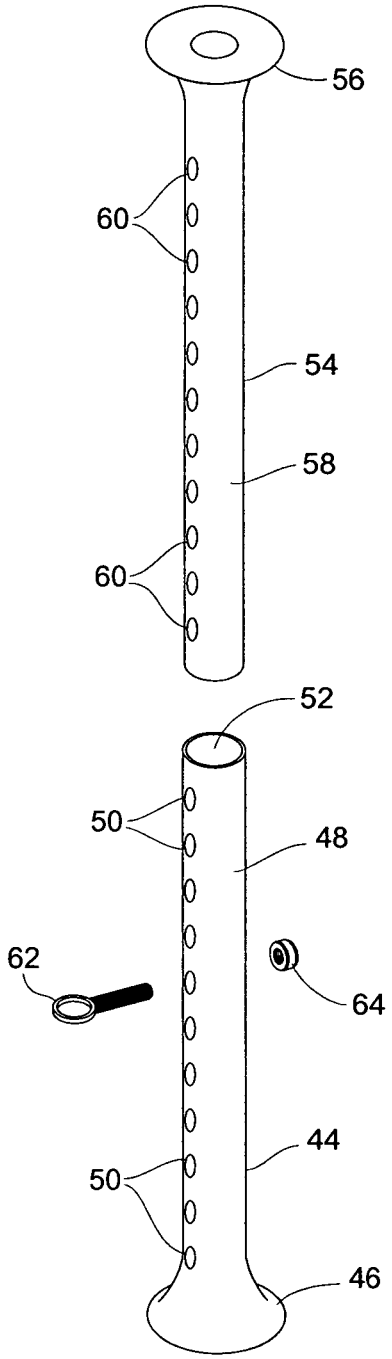
FIG. 7 is a perspective view of the portable and adjustable trench support of the present invention illustrating the alignment of one large diameter support arm with one small diameter support arm prior to the telescopic insertion of the small diameter support arm into the bore of the large diameter support arm.
Figure 8:
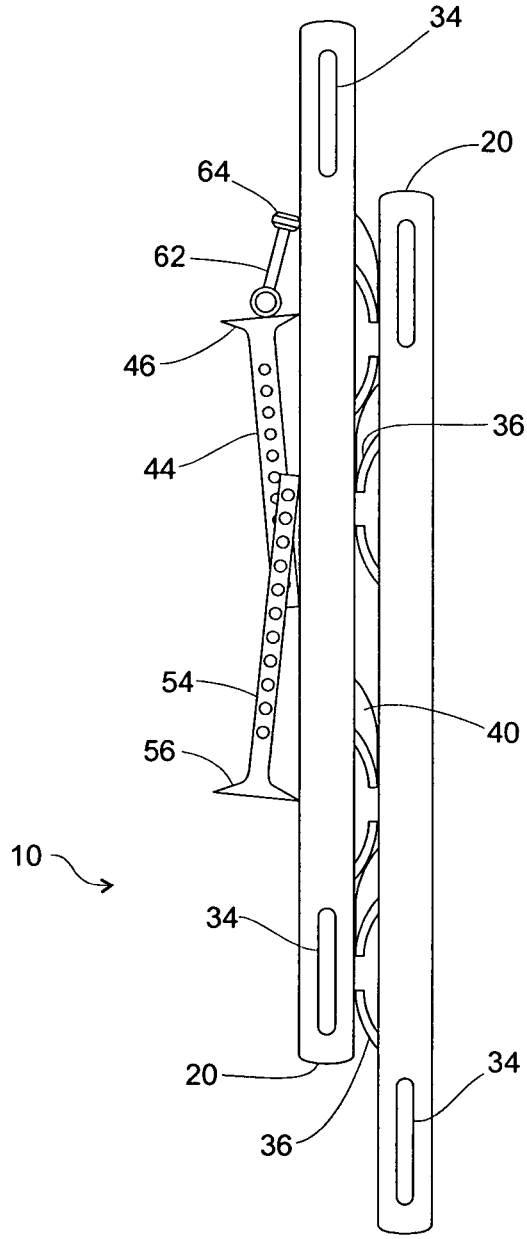
FIG. 8 is a side elevational view of the portable and adjustable trench support of the present invention illustrating the components of the trench support stacked upon each other for transport or storage.
Figure 9:
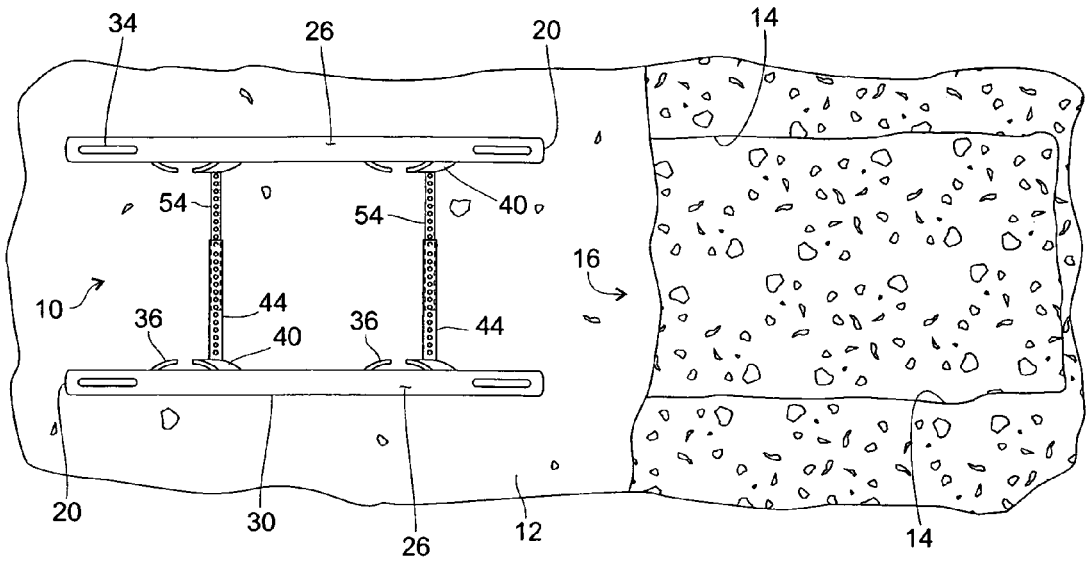
FIG. 9 is a top plan view of the portable and adjustable trench support of the present invention illustrating the trench support assembled and aligned with the trench prior to disposition therein.
Figure 10:
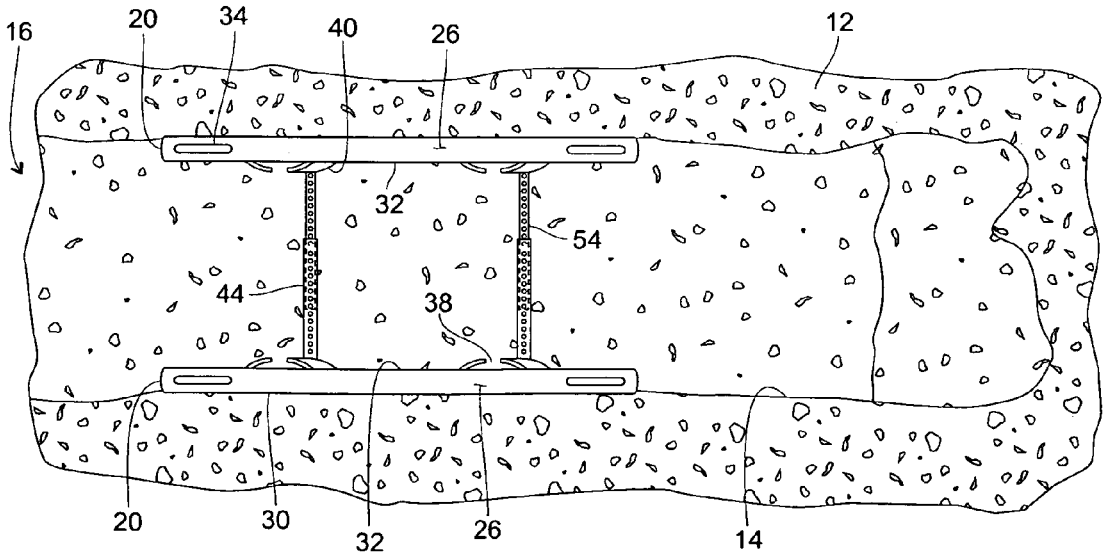
FIG. 10 is a top plan view of the portable and adjustable trench support of the present invention with the trench support placed within the trench and the support plates spaced from each other by the support arms and abutting the opposed walls of the trench for shoring up the trench and protecting workers located within the trench.

Slidably disposed within the channels 38 for seating within the offset slots 42 of the l-shaped offsets 40 is a plurality (at least four pairs) of mating and interfitting support arms distinguished by having two distinct diameters. While it is possible that just two pairs of support arms could be used, safety and liability generally necessitate four pairs of support arms. More specifically, the support arms for all the pairs include a first larger diameter support arm 44 that has a flared insertion end 46 that is slidably insertable and movable within channels 38 and within the slots 42 of the l-shaped offsets 40, a shank 48, a plurality of apertures 50 spaced along the shank 48, and a bore 52 extending through the shank 48. As shown in FIGS. 3-5, and implied in FIG. 7, the apertures 50 are located on both the upper side and lower side of the shank 48 for all the support arms 44; and, more specifically, the apertures 50 are arranged in aligned pairs with an aperture 50 on the upper side of shank 48 being aligned with a corresponding aperture 50 on the lower side of the shank 48.

As illustrated in FIGS. 2-5, 7, 9, and 10, in addition to the first (larger) diameter support arms 44 are a plurality—at least four—second (smaller diameter) support arms or rods 54 each of which is telescopically receivable and adjustable within each corresponding large diameter support arm 44. For each larger diameter arm 44 there must be one smaller diameter support arm 44. Each (at least four) of the second smaller diameter support arms 54 includes a second flared insertion end 56 that is slidably insertable and movable within the channels 38 and the slots 42 of the l-shaped offsets 40, a second shank 58, and a plurality of through holes 60 spaced along the shank 58 with the through holes 60 further spaced along the upper side and opposite lower side of the shank 58 for each of the smaller support arms 54. More specifically, the through holes 60 are arranged in aligned pairs with each pair consisting of one through hole 60 located on the upper side and one through hole 60 located on the lower side of the shanks 58. The shanks 58 of the second support arms 54 are slidably adjustable in a linear orientation and telescopically receivable within the bores 52 of large support arms 44. Also, the flared insertion ends 46 and 56 have the same diameter for snugly fitting and sliding within the channels 38 and the slots 42 of the l-shaped offsets 40.

A representative method of assembling the trench support 10 will now be described. After the desired width of the trench support 10 has been determined, and then dug by the appropriate machinery, the support plates 20 are positioned so that they are setting upright on the ground surface 12 beside and in alignment with the trench 16 and the respective trench walls 14. The proper width or spacing of the support plates 20 can thus easily be arrived without the need for obtaining precise measurements. The four large diameter support arms 44 are then slid, one at a time, down into the channels 38 of support arm guides 36 by placing the flared insertion ends 46 flush against the interior sides 32 of the plates 20, and then sliding the larger support arms 44 through the upper opening of the channels 38 down and then laterally through the slots 42 of the desired offsets 42. Each support plate 20 includes two support guides 36 mounted to the interior side 32, and each support guide 36 includes four offsets 40. Two support arms 44 are placed in the desired vertical positions of two offsets 40 for one of the support arm guides 36, and then the other two support arms 44 are slid successively down into the offsets 40 of other support arm guides 36 corresponding in vertical position to the placement of first set or pair of support arms 44. Should any of the support arms 44 need repositioned, they can simply be slid up out of the offsets 40 and then slide up or down the respective channels 38 of the support arm guides 36 and into another offset 40. Thus, the positioning, placement, repositioning, and removal doesn't require the employment of fasteners, screws, bolts, clamps, etc. but simply the slidable vertical movement along—up and down—the channels 38 of the support arm guides 36. As will be hereinafter explained, this also applies to the positioning and repositioning of the smaller diameter support arms 54.

The second smaller diameter support arms 54 (four altogether in the preferred embodiment) are then slidably disposed within the channels 38 of the support arms guides 36 and then further slid into the appropriate offsets 40. Thus, two smaller support arms 54 disposed in one support arm guide 36 and the other two smaller support arms 54 are slid down into the channel 38, and then the offsets 40 that correspond to the offsets 40 wherein the first pair of smaller support arms 54 are located. In addition, the placement of the larger support arms 44 on one support plate 20 must correspond to the placement of the smaller support arms 44 on the opposite support plate 20 so that the larger support arms 44 are aligned with their opposite and corresponding smaller support arms 54.

With the four larger support arms 44 disposed in alignment with their corresponding smaller support arms 54, the plates 20 are brought closer together so that the smaller support arms 54 can be inserted within the bores 52 of the larger diameter support arms 44. The telescopic insertion of smaller support arms 54 into the larger support arms 54 allows for the linear back and forth positioning of the smaller diameter arms 54 thereby allowing for the support plates 20 to be appropriately spaced from each other commensurate to the width of the trench 16 so that when the trench support 10 is positioned within the trench 16, the trench wall sides 30 of both support plates 20 are located adjacent and abutting the trench walls 14. When the desired width or spacing of the plates 20 has been attained, a plurality of locking bolts 62 are then inserted completely through all of the aligned apertures 50 on shanks 48 of larger support arms 44 and through holes 60 of the shanks 58 of the smaller support arms 54 and locking nuts 64 are fastened to the ends of the bolts 62 thereby locking all the interfitting pairs of support arms 44 and 54 together. All the support arms 44 and 54 are thus telescopically adjustable in the horizontal orientation relative to the floor 18 of the trench 16 as well as being slidably adjustable, positionable and repositionable in and along the vertical orientation within the channels 38 of the support arm guides 36, and relative to the support plates 20 and the vertical height of the trench walls 14.

The trench support 10 can be repositioned along the length of the trench 16 by hooking one or more hooks from excavating or construction machinery onto the eyes 34 projecting up from the upper flat surfaces 26 of plates 20, and then simply lifting and pulling the trench support 10 to the new position; or the trench support 10 can be completely lifted up out of the trench 16 in the same manner and then placed back into the trench 16. The positioning of the pairs of connected larger and smaller support arms 44 and 54 can occur even when the trench support 10 is positioned within the trench 16 by slidably moving the interconnected pairs of larger and smaller support arms 44 and 54 up or down within the channels 38 to a different horizontal orientation. The is an especially valuable feature as workers often need additional space or clearance to work and move within the trench 16 for the placement of conduit and pipe; and such adjustability would be impossible with crossbeams and cross bars that were welded or fastened directly to such support plates.

After work in the trench 16 has been completed and the trench support 10 has been removed and placed upon the ground surface 12, the trench support 10 can be easily broken down for transport and storage by sliding the arms 44 and 54 out of the offsets 40 and up out of the channels 38 thereby disconnecting and detaching the support plates 20. The support plates 20 can then be laid upon each other, and the support arms 44 and 54 can be detached by removing nuts 64 from bolts 62 and sliding smaller arms 54 out of larger arms 44. The support arms 44 and 54 can be placed on the plates 20, and then arms 44 and 54, plates 20, bolts 62 with nuts 64 placed thereon all can be lifted and placed in the bed of a dump truck, pickup truck, or on the flat bed of tractor trailer for transport to a new work site or transport to a storage facility.

While the present invention has been described with respect to a specific embodiment, it will be understood by those skilled in the art that numerous modifications, alterations, and variations are possible and practicable, and will still come within and be encompassed by the description of the invention as set forth herein and will also be encompassed by the scope and ambit of the herein appended claims.

I claim:

1. A portable and adjustable trench support for placement within a trench for shoring up the opposed walls of the trench, comprising:

a pair of support plates with each support plate including an interior side, an opposite trench wall side, an upper end, an opposite lower end, an upper flat surface adjacent the upper end, and the interior sides facing each other when trench support is placed within the trench;

a plurality of support arm guides with at least two support arm guides spaced from each other and mounted to the interior side of one support plate and at least two support arm guides spaced from each other and mounted to the interior side of the other support plate;

each support arm guide extending from the upper end to the lower end of the respective support plate and including a channel coequal in length with the support arm guide;

a plurality of l-shaped offsets with at least four offsets laterally extending from each support arm guide and being adjoined thereto;

each l-shaped offset including an offset slot that registers with the channel of the respective support arm guide;

a plurality of larger diameter support arms slidably mountable to the support arm guides of the support plates;

a plurality of smaller diameter support arms slidably mountable to the support arm guides of the support plates;

the smaller diameter support arms being telescopically receivable within the respective larger diameter support arms and selectively linearly adjustable with respect thereto for obtaining the appropriate spacing of the support plates within the trench so that the support plates abut the opposed walls of the trench; and whereupon the larger diameter support arms are slidably disposed within the channels of the support arm guides of one support plate and then further slid into the desired l-shaped offsets and the smaller diameter support arms are slidably disposed within the channels of the support arms guides of the other support plate and then further slid into the desired l-shaped offsets whereby each larger diameter support arm is positioned opposite one smaller diameter support arm thereby allowing each smaller diameter support arm to be telescopically received within and then secured to the corresponding larger diameter support arm resulting in the support plates being spaced from each other a distance commensurate with the width of the trench so that the support plates are positioned adjacent to the walls of the trench when the trench support is placed within the trench.

2. The portable and adjustable trench support of claim 1 further comprising a plurality of loops mounted to and projecting from the upper flat surfaces of both support plates with the loops capable of receiving hooks, chains, and cables for positioning and moving the support plates and the trench support within the trench and from one work site to another work site.

3. The portable and adjustable trench support of claim 2 wherein each larger diameter support arm includes a flared insertion end, a shank, a plurality of apertures spaced along the shank, and a bore extending through the shank.

4. The portable and adjustable trench support of claim 3 wherein the flared insertion end of each larger diameter support arm is slidably receivable within and movable along the channels and the l-shaped slots of the l-shaped offsets that are connected to the support arm guides for both support plates.

5. The portable and adjustable trench support of claim 4 wherein each smaller diameter support arm includes a second flared insertion end, a second shank, and a plurality of through holes spaced along the shank.

6. The portable and adjustable trench support of claim 5 wherein the second flared insertion end of each smaller diameter support arm is slidably receivable within and movable along the channels and the l-shaped slots of the l-shaped offsets that are connected to the support arm guides for both support plates.

7. The portable and adjustable trench support of claim 6 further comprising a plurality of locking bolts that are insertable through the aligned apertures and through holes of the larger diameter support arms and the smaller diameter support arms for securing the smaller diameter support arms to the larger diameter support arms after the smaller diameter support arms and the larger diameter support arms have been mounted to the respective support arm guides of the support plates.

8. A portable and adjustable trench support for placement within a trench for shoring up the opposed walls of the trench, comprising:

a pair of support plates with each support plate including an interior side, an opposite trench wall side, an upper end, an opposite lower end, the upper end defined by an upper flat surface, and the interior sides facing each other when the trench support is disposed within the trench;

a plurality of support arm guides with at least two support arm guides mounted to the interior side of one support plate and at least two support arm guides mounted to the interior side of the other support plate and each support arm guide including a channel coequal in length to the respective support arm guide;

a plurality of l-shaped offsets with at least four offsets laterally extending from each support arm guide and being mounted to the interior side of that support plate;

each l-shaped offset including an offset slot that registers with the channel of the respective support arm guide from which the l-shaped offset extends;

a plurality of larger diameter support arms slidably mountable to the support arm guides of both support plates;

a plurality of smaller diameter support arms slidably mountable to the support arm guides of both support plates;

the smaller diameter support arms being telescopically receivable within the respective larger diameter support arms and selectively linearly adjustable therein for obtaining the appropriate spacing of the support plates within the trench so that the support plates abut the opposed walls of the trench; and whereupon the larger diameter support arms are slidably disposed within the channels of the support arm guides of one support plate and then further slid into the desired l-shaped offsets and the smaller diameter support arms are slidably disposed within the channels of the support arm guides of the other support plate and then further slid down into the desired l-shaped offsets whereby each larger diameter support arm is positioned opposite one smaller diameter support thereby allowing each smaller diameter support arm to be telescopically received within and then secured to the corresponding larger diameter support arm for spacing the support plates a distance from each other commensurate with the width of the trench so that the support plates are positioned adjacent to the walls of the trench when the trench support is disposed within the trench.

9. The portable and adjustable trench support of claim 8 wherein the support arm guides extend from the upper ends to the lower ends of the respective support plates to which they are mounted.

10. The portable and adjustable trench support of claim 9 further comprising a plurality of loops mounted to and projecting from the upper flat surfaces of both support plates with the loops capable of receiving hooks, chains, and cables to facilitate the positioning and moving of the support plates and the trench support within the trench and from one work site to another work site.

11. The portable and adjustable trench support of claim 10 wherein each larger diameter support arm includes a flared insertion end, a shank, a plurality of apertures spaced along the shank, and a bore extending through the shank.

12. The portable and adjustable trench support of claim 11 wherein the flared insertion ends of the larger diameter support arms are slidably receivable within and movable along the channels and the l-shaped offsets that are connected to the support arm guides on both support plates.

13. The portable and adjustable trench support of claim 12 wherein each smaller diameter support arm includes a second flared insertion end, a second shank, and a plurality of through holes spaced along the second shank.

14. The portable and adjustable trench support of claim 13 wherein the second flared insertion ends of the smaller diameter support arms are slidably receivable within and movable along the channels and the l-shaped slots of the l-shaped offsets that are connected to the support arm guides for both support plates.

15. The portable and adjustable trench support of claim 14 further comprising a plurality of locking bolts that are insertable through the aligned apertures and through holes of the larger diameter support arms and the smaller diameter support arms for securing the smaller diameter support arms to the larger diameter support arms after the smaller diameter support arms and the larger diameter support arms have been mounted to the support arm guides of the respective support plates.

* * * * *